US006827296B1

(12) United States Patent
Novick et al.

(10) Patent No.: US 6,827,296 B1
(45) Date of Patent: Dec. 7, 2004

(54) METHOD AND APPARATUS FOR ATOMIZING FLUIDS WITH A MULTI-FLUID NOZZLE

(75) Inventors: Vincent J. Novick, Downers Grove, IL (US); Rajesh K. Ahluwalia, Burr Ridge, IL (US)

(73) Assignee: The United States of America as represented by the United States Department of Energy, Washington, DC (US)

( * ) Notice: Subject to any disclaimer, the term of this patent is extended or adjusted under 35 U.S.C. 154(b) by 0 days.

(21) Appl. No.: 10/642,240

(22) Filed: Aug. 18, 2003

(51) Int. Cl.[7] ..... F23D 11/16

(52) U.S. Cl. ..... 239/422; 239/416.1; 431/171; 431/286

(58) Field of Search ..... 239/422, 426, 239/400, 416.1, 424, 524; 431/171, 286, 347, 284, 180

(56) References Cited

U.S. PATENT DOCUMENTS 4,134,719 A * 1/1979 Velie ..... 431/171
4,473,185 A * 9/1984 Peterson et al. ..... 239/8

* cited by examiner

*Primary Examiner*—Michael Mar
*Assistant Examiner*—Thach H. Bui
(74) *Attorney, Agent, or Firm*—Brian J. Lally; Daniel D. Park; Paul A. Gottlieb

(57) ABSTRACT

The invention relates to a method an apparatus for atomizing liquids. In particular, the present invention relates to a method and apparatus for atomizing heavy hydrocarbon fuels such as diesel, as part of a fuel reforming process. During normal operating conditions the fuel is atomized by a high pressure fluid. Under start-up conditions when only a low pressure gas is available the fuel films across part of the nozzle and is subsequently atomized by a radially directed low pressure dispersion gas.

46 Claims, 6 Drawing Sheets

NOZZLE END CAP

NOZZLE BODY

FIG. 3A
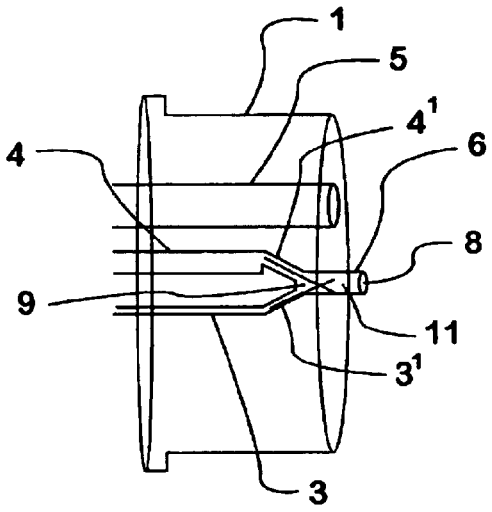
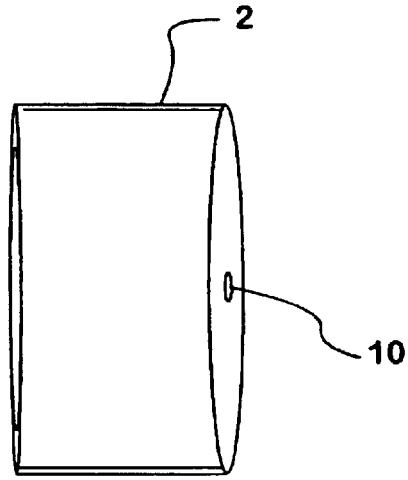
FIG. 3B
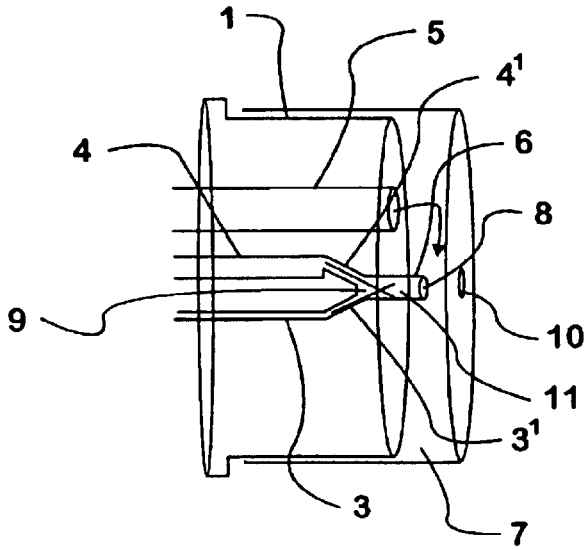
FIG. 3C

METHOD AND APPARATUS FOR ATOMIZING FLUIDS WITH A MULTI-FLUID NOZZLE

U.S. GOVERNMENT RIGHTS

The United States Government has rights in this invention pursuant to Contract No. W-31-109-ENG-38 between the U.S. Department of Energy and the University of Chicago, representing Argonne National Laboratory.

TECHNICAL FIELD

The invention relates to a method and apparatus for atomizing liquids. In particular, the present invention relates to a method and apparatus for atomizing liquids during normal operating conditions when a high pressure fluid is available for atomization as well as under start-up conditions when only a low pressure gas is provided. The presented embodiment relates to a method and apparatus for atomizing heavy hydrocarbon fuels such as diesel, as part of a fuel reforming process.

BACKGROUND OF THE INVENTION

Fuel cell technology is an efficient and environmentally friendly power source that has the potential to revolutionize the transportation industry. Unlike fossil fuels that produce undesirable by-products such as sulfur dioxides, nitrogen oxides and carbon monoxide, fuel cells powered by pure hydrogen are virtually emission free. The problem is that although hydrogen exists on Earth in vast amounts it rarely exists in its pure $H_2$ form. Therefore, one of the keys to bringing fuel cells to the mass market (for example use in vehicles) is finding a pure hydrogen source that is both environmentally responsible and economically feasible. Some fuel cell cars are being developed to operate on pure hydrogen (produced at off-site plants) that is pumped directly into the car. The drawback of this approach is that it would require the expenditure of hundreds of billions of dollars to create a new hydrogen distribution network.

Using on-board reformers that convert commercially available hydrogen sources like gasoline and diesel to hydrogen are becoming increasingly attractive. The reformation of hydrocarbon fuels releases $CO_2$ and other gases at substantially lower amounts than existing vehicles. Furthermore, using commercially available fuels as the source of hydrogen would save billions in infrastructure costs.

Catalytic auto-thermal reforming ("ATR") is one of the most effective methods of producing hydrogen from heavy hydrocarbons like gasoline and diesel. In ATR, sub-stoichiometric amounts of air partially oxidize the fuel and liberate heat for the endothermic reactions involving steam. During start-up conditions steam is generally not available and hydrogen is produced by partial oxidation of the fuel. During normal operating conditions the hydrocarbon feed stocks are reformed to a hydrogen rich stream by passing the air, steam, and raw fuel over a catalyst bed in the reformer (See, U.S. Pat. No. 6,045,772 issued to Szydlowski et al., issued on Apr. 4, 2000). The actual product yield depends on the catalyst, fuel composition and reactor efficiency. In operation a number of factors influence reactor efficiency including: the amount of mixing between the air, steam and fuel, the method of injection of the fuel-steam-air mixture into the reactor, and the pressure drop of air across the system.

One of the most important factors of ATR efficiency is proper mixing of the fuel, steam and air before contacting the catalyst. Incomplete mixing and gas phase reactions lead to temperature non-uniformities and poor hydrocarbon conversion. Hot spots result if the mixture is locally air rich producing conditions that are favorable for the catalysts to sinter. Coke formation occurs if the mixture is locally fuel rich or lean in $H_20$, decreasing the efficiency of the reactor.

When reforming heavy hydrocarbons, the method of obtaining a well mixed water-fuel-steam spray and injecting it into the reforming reactor is critical. Previous experience with diesel fuel indicates that heavy hydrocarbons need to be injected directly into the ATR as a liquid, since attempts at vaporization generally lead to coke formation. See, U.S. Pat. No. 6,444,179 issued to Sederquist, on Sep. 3, 2002. Optimal efficiency is obtained when the fuel is atomized into droplets of approximately 10 $\mu$m or finer. Mechanical atomizers are generally limited to producing droplets that are about 50 $\mu$m, which is too large to provide adequate mixing and coke free operation. Therefore, high pressure, gas assisted atomizers are needed to atomize the fuel into a proper droplet size.

From the standpoint of fuel cell efficiency, it is desirable to minimize the pressure drop of the air across the ATR system and specifically across the spray nozzle. The increased air pressure required to overcome a large air side pressure drop has a high energy cost and negatively impacts system efficiency. For this reason the nominal air drop across the nozzle should be restricted to about 1 psi.

Because the power required to pump liquids is much less than that of air, the pressure drops for the atomizing liquid and feed stock can be much higher than the air side drop and are nominally specified to be less than 200 psi.

Steam is the preferable atomizing fluid. However, under ATR start up conditions steam is not available and only air can be used for atomization.

There is a need in the art for a method and apparatus that atomizes heavy hydrocarbon fuels for insertion into an ATR. In particular, there is a need in the art for a method and an apparatus for atomizing heavy hydrocarbons that intimately mixes the air, steam and fuel, produces droplet sizes of around 10 $\mu$m during normal conditions, limits the air drop across the nozzle to around 1 psi, and is operable during both normal and start-up conditions.

SUMMARY OF INVENTION

The three-fluid atomizing nozzle generally comprises a nozzle body and nozzle cap. The nozzle body houses at least three fluid/gas lines including: a feed stock tube (supplying the fluid to be atomized), a high pressure atomization fluid tube (i.e. steam) and a low pressure dispersion fluid tube (i.e. air). The nozzle cap attaches to the nozzle body and forms a mixing chamber where the three fluids mix during normal operation.

Water particularly in the form of steam is the preferred atomizing fluid, however, other fluids capable of atomization could also be used. The feed stock can be any liquid that needs to be atomized. The presented embodiments use air as the dispersion gas, however, other gasses could also be used.

During normal operating conditions the atomizing fluid is fed from the atomizing tube into the atomization cavity of the nozzle body. The atomizing fluid interacts with the feed stock supplied by the parallel feed stock tube. The streams of feed stock liquid and atomizing fluid are oriented in a way to achieve intimate mixing of the two streams. Angling the streams toward each other is one way to ensure proper mixing and to encourage atomization. The flow rates and pressures of the atomizing and feed stock streams should be at sufficient levels to atomize the fluids into a desired droplet size. Multiple atomizing tubes may used to achieve increased atomization.

A nosepiece located at the convergence of the feed stock and atomizing streams straightens out the atomized feed stock jet. In addition, at startup the nosepiece causes the feed stock to film across the sharp edged surface of the nosepiece.

The feed stock and atomizing streams interact and the atomizing fluid atomizes the feed stock. The resulting atomization fluid-feed stock spray passes through the nosepiece aperture and issues into a mixing chamber that is formed when the nozzle cap is attached to the nozzle body.

A dispersion gas is introduced through the dispersion gas tube that runs parallel to the feed stock and atomizing tubes. As the dispersion gas exits the nozzle body it is forced to turn by the nozzle cap that surrounds the nozzle body promoting mixing between the feed stock, high-pressure atomizing fluid (when available) and low-pressure dispersion gas. The geometry of the cap should allow the dispersion fluid to be directed radially into the atomized feedstock spray. The resulting well mixed spray exits an aperture in the nozzle cap producing a spray with desired droplet size. The diameter of the nozzle cap's aperture determines the extent of mixing between the feed stock, atomizing liquid and dispersion gas.

During start-up conditions (in an ATR) steam is usually not available and atomization must be achieved without the use of a high-pressure atomizing fluid. The three-fluid atomizing nozzle is designed to allow the feed stock to film across the sharp-edged nosepiece. The low velocity dispersion gas radially interacts with this feed stock film atomizing the feedstock into a slightly coarser spray than achieved under normal conditions when the high pressure atomization fluid is available.

The invention involves supplying a stream of feed stock liquid into a atomization chamber with at least one high pressure atomization jet; orienting the high pressure atomization jet(s) and feed stock streams in a way to achieve intimate mixing of the two streams; atomizing the feed stock stream with the atomization fluid from said atomization jet(s) forming droplets containing a well mixed atomizing fluid-feed stock mixture; directing the atomizing fluid-feed stock spray into a mixing chamber; radially inserting a dispersion air into the mixing chamber, forming a well mixed atomizing-feed stock-dispersion spray mixture.

During start-up conditions where a high pressure atomizing fluid is not available, the feed stock forms a film and the dispersion gas radially contacts the feed stock film atomizing the feed stock into droplets.

When used in conjunction with an ATR, the present invention allows the atomization of a fuel source in both normal and start-up conditions. During normal operations the fuel is atomized with a high pressure steam, forming atomized fuel-steam droplets which are subsequently mixed with air allowing for autothermal reformation of the mixture. During start-up (when no steam is available and therefore no high pressure steam for atomization or for use in the autothermal reaction) the fuel forms a film over part of the nozzle and the fuel is atomized by a radially directed low pressure air source, forming atomized fuel-air droplets allowing reformation of the fuel by partial oxidation until enough steam is generated to proceed with normal operation.

BRIEF DESCRIPTION OF THE DRAWINGS

FIG. 3A—is a cross-sectional view of the nozzle body;

FIG. 3B—is a cross-sectional view of the nozzle cap;

FIG. 3C—is a cross-sectional view of the nozzle cap engaged with the nozzle body.

DETAILED DESCRIPTION OF THE PREFERRED EMBODIMENTS

The present embodiment relates to a method and apparatus for atomizing heavy-hydrocarbon fuels (in this case diesel) for insertion into an ATR using steam to atomize the fuel at normal operating conditions and air to atomize the fuel during start up.

The present embodiment allows the atomizaton of a fuel source in both normal and start-up conditions. During normal operations a stream of high pressure steam is used to atomize the fuel, forming atomized fuel-steam spray which is subsequently mixed with air allowing autothermal reformation of the mixture. During start-up (when no steam is available) the fuel forms a film over part of the nozzle and the fuel is atomized by a radially directed low pressure stream of air, forming atomized fuel-air spray allowing reformation of the fuel by partial oxidation until enough steam is generated to proceed with normal operation.

FIGS. 1A-D, 2A-D and 3A-C are schematic illustrations of several embodiments of the present three-fluid atomizing nozzle. The atomizing nozzle generally comprises: a nozzle body 1, nozzle end cap 2, fuel tube (feed stock) 3, water/steam (atomizing fluid) tube 4, and air tube (dispersion gas) 5.

The parts of the present embodiment were constructed of metal, however, other resilient materials that can withstand the pressures and other stresses associated with atomization could also be used.

Figure 1C:
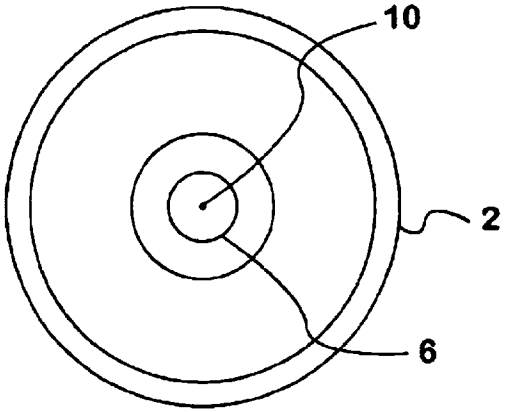
FIG. 1C—is an end on view of the nozzle cap.
Figure 1D:
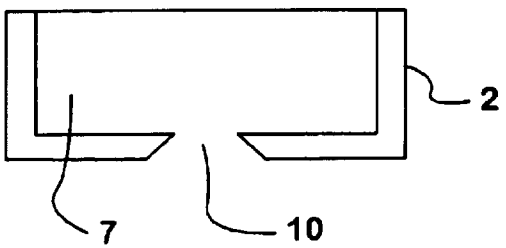
FIG. 1D—is a side cross-sectional view of the nozzle cap.
Figure 1A:
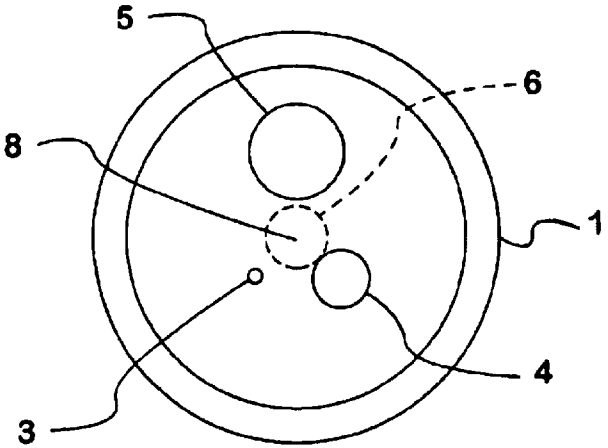
FIG. 1A—is an end on view of the nozzle body.
Figure 1B:
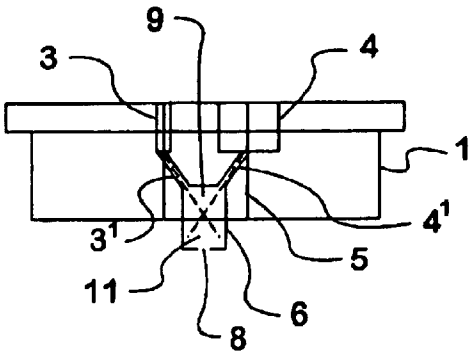
FIG. 1B—is a side cross-sectional view of the nozzle body.
Figure 2C:
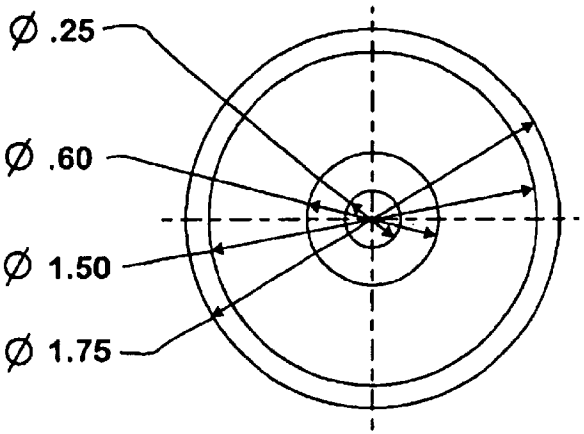
FIG. 2C—is a top on view of the nozzle cap with dimensions.
Figure 2D:
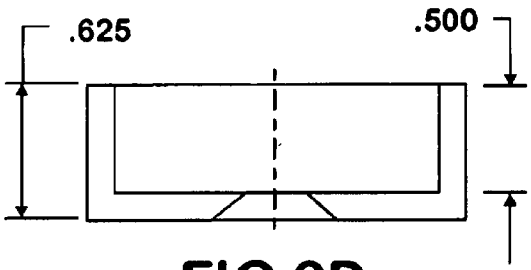
FIG. 2D—is a side cross-sectional view of the nozzle cap with dimensions.
Figure 2A:
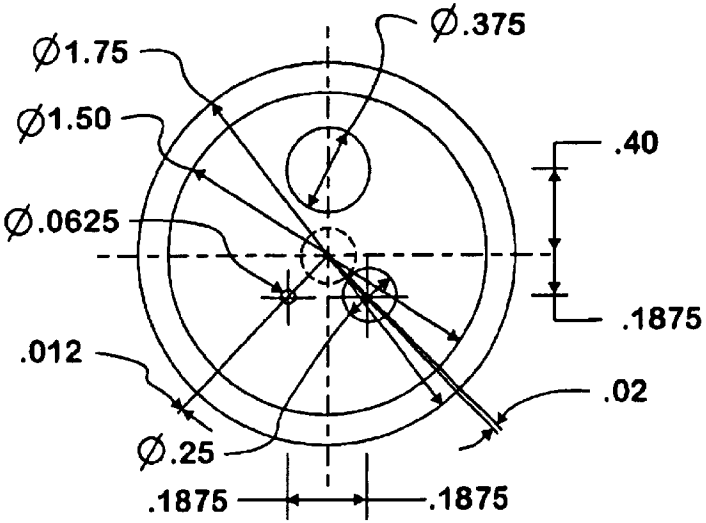
FIG. 2A—is an end on view of the nozzle body with dimensions.
Figure 2B:
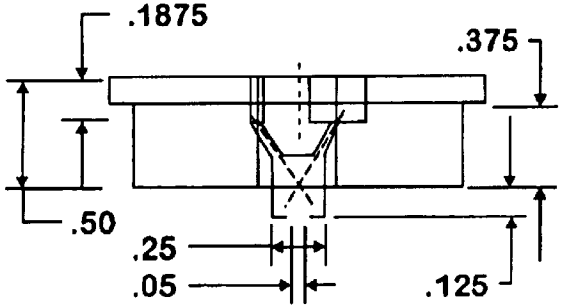
FIG. 2B—is a side cross-sectional view of the nozzle body with dimensions.

The nozzle body 1 of the present embodiment is generally cylindrical in shape and has a central cavity 9, as shown in FIG. 3A. The cavity 9 continues into a nosepiece 6 as shown in FIGS. 1B and 3A. The nosepiece 6 has a chamber 11 and a central aperture 8. In the present embodiment the diameter of the nosepiece aperture 8 was approximately 0.05". See, FIGS. 1–3. An acceptable range for the diameter of the nosepiece aperture is between 0.010–0.250", preferably between 0.025–0.100". The nosepiece 6 extends out of the nozzle body 1 and serves two purposes: during normal conditions it straightens out the feed stock-atomization spray and second, during start up it allows a film of feed stock to form over it which is then atomized by the radially directed dispersion gas stream.

The nozzle cap 2 is complementary in shape to the nozzle body 1 and engages the nozzle body 1 forming a mixing chamber 7 between the attached nozzle cap 2 and nozzle body 1, as shown in FIG. 3C. The mating of the nozzle cap 2 and nozzle body 1 can be accomplished in a variety of ways including screwable attachment.

The mixing chamber 7 encourages mixing between the different nozzle fluids. In the present embodiment the nozzle cap 2 screws on to nozzle body 1, however, other attachment means can be envisioned. The nozzle cap 2 has a central aperture 10. See, FIGS. 1C and 1D. The nozzle cap 2 screws on to the nozzle body until the clearance between the nozzle body 1 and nozzle cap 2 is between 0.175"–0.375", preferably between 0.225"–0.275". A suitable clearance between then nosepiece 6 and nozzle cap 2 is between 0.05"–0.25", preferably between 0.10" and 0.15", FIGS. 3A–C. These clearances are important because as discussed later, these distances determine the direction and velocity of the dispersion air when it enters the mixing chamber 7. If the distance is to large the velocity will not be sufficient to atomize the fuel upon start-up and the air will not be directed radially as needed. If the distance is too small the resulting increase in air pressure drop will decrease efficiency. These distances can be modified according to desired results.

The steam tube 4 has a first and second end 4' and runs partway through of the nozzle body 1 terminating in the nozzle body's cavity 9. FIGS. 1A, 1B, 3A-C. The first end of the steam tube 4 is attached to a steam source such as an ATR reactor and the steam is pumped through the tube by a pump (not shown). The steam tube 4 has defined diameter that narrows at the second end of the tube 4' to efficiently drop the pressure and increase the velocity of the water/steam being introduced. FIG. 1B. The second end of the steam tube 4' extends into the nozzle body's cavity 9 and is angled so that the steam exiting the steam tube 4' is directed toward the center of the nozzle body's cavity 9, as shown in FIG. 1B. In the present embodiment the second end of the steam tube 4' is angled at approximately 30' off vertical as shown in FIGS. 1B and 3A. The steam tube 4 of the present embodiment has a initial diameter of ¼" narrowing to a 0.030" passage at its second end 4'. The diameter of the tube can be modified to achieve desired pressures, velocities, flow rates and other characteristics.

The fuel tube 3 has a first end and second end 3', the first end being attached to a fuel source. The fuel is pumped through the fuel tube 3 using a liquid pump assembly. (not shown) The fuel tube 3 runs parallel to the steam tube 4, the fuel tube 3 can have a narrower diameter at its second end 3' for maximizing the stability of the fuel flow rate. FIG. 1B. The second end of the fuel tube 3' extends into the nozzle body's cavity 9 and is angled so that the fuel exiting the fuel tube 3' is directed toward the center of the nozzle cavity 9 and into the nosepiece chamber 11. In the present embodiment the second end of the fuel tube 3' is angled at approximately 30' off center as shown in FIG. 1B. The fuel tube 3 of the present embodiment had a diameter of ⅛" narrowing to a 0.011" passage at its second end 3'. The angles and orientation of the fuel and steam tubes can be adjusted for optimal performance, preferably keeping their angles between 10 and 45' off center.

The steam and fuel streams meet each other in a small chamber 11 extending into the nosepiece 6, as show in FIGS. 1B and 3A. The steam atomizes the liquid fuel into a fine spray that issues though the aperture in the nosepiece 8 and into a cavity 7 between the nozzle body 1 and the nozzle cap 2. FIG. 3C. The size of the droplets formed is partially a function of the amount of pressure maintained by the steam tube 4. To obtain droplet sizes of approximately 10 $\mu$m it was found that a pressure range (at the first end of the steam tube 4 of between 5–200 psig was acceptable, preferably between 10 and 60 psig. Obtaining different droplet sizes can be achieved by altering the pressure of the steam. (*Atomization and Sprays*, Arthur Henry Lefebvre; and *Atomization and Spray Drying*, W. R. Warshall, Jr., American Institute of Chemical Engineers, 1954)

The air tube 5 runs through the body of the nozzle 1 parallel to the fuel 3 and water 4 tubes. FIG. 1B. Unlike the fuel 3 and water 4 tubes, the air tube 5 does not terminate in the nozzle body's cavity 9. FIG. 3A. Instead the air tube continues through the nozzle body 1 terminating at the end of the nozzle body 1. The air flows from an air source, through the air tube 5 and into the cavity 7 formed between the nozzle body 1 and cap 2. The air is pumped from an air source by an air pump (not shown) The air exits the nozzle body 1 and is forced to turn by the nozzle cap 2 that surrounds the end of the nozzle to promote mixing between the fuel-steam and the air. The geometry of the cap 2 allows the air to be directed radially into the fuel-steam spray. The resulting well-mixed fuel-steam-air spray exits the cap aperture 10 and enters the headspace of a reformer. The diameter of the nozzle cap aperture 10 determines the extent of the mixing between the air and fuel-steam mixture. The smaller the cap aperture 10 the better the mixing, however, at the expense of the air-side pressure drop. In the present invention the diameter of nozzle cap's aperture 10 was 0.25". It was found that an acceptable range for the nozzle cap's aperture was between 0.05–1", preferably between 0.1–0.50". In the present embodiment the air tube 5 had a diameter of ⅜". The pressure of the air was maintained around 1 psi to maximize efficiency.

The atomizing fluid, feed stock and dispersion tubes can be attached to and mounted within the nozzle body by various means. The said tubes can be pressure fitted, soldered, or otherwise attached to the nozzle body.

The nozzle body chamber, nosepiece and other parts can alternatively be machined out of a solid nozzle body structure. In such an embodiment the various tubes (feed stock, dispersion and atomizing) are channels machined out of the nozzle body. The channels would have a means for attaching to an outside source of gas/fluid. The machined channels could be machined to achieve the same characteristics as the tubes and achieve similar atomization properties.

The pressures, flow rates, velocities, reactant ratios and other characteristics of the three fluids can be modified to achieve desired results. In the present embodiments the abovementioned characteristics were determined by idealized reformation equations, desired droplet size and other factors. See, J. H. Hirschenhofer et al., *Fuel Cell Handbook*, fourth edition, U.S. Dept. of Energy Office of Fossil Energy. Such characteristics could be altered when the present invention is used for other applications.

ATR heat exchangers. Optionally, the present nozzle can nebulize liquid fuel and liquid water with the help of atomization air. The hardware does not change. We simply bring in liquid water through the steam pipe. The two streams fill up the cavity and form a film that is broken up by the dispersion air. The mechanism is exactly the same as being used in the start-up mode with liquid fuel and air. This way steam can be created during startup and a separate steam generation means is not necessary.

TABLE 1

| | Liquid Flow | Atomizing Gas Flow | Dispersion Gas Flow | Atomizing Gas Pressure | Dispersion Gas Pressure | $H_2O/C$ Ratio | $O_2/C$ Ratio | D30 | Mean Droplet Velocity |
|---|---|---|---|---|---|---|---|---|---|
| Design | 10 cc/min | 21 slpm | 75 slpm | 51 psig | 1 psig | 1.5 | 0.5 | 8.3 + −2.7 μm | 10.7 + −14.1 m/s |
| Max Turndown | 3 cc/min | 6.3 slpm | 25 slpm | 10 psig | 0 | 1.5 | 0.5 | 8.0 + −2.3 μm | 4.3 + −6.1 m/s |
| Start-Up | 10 cc/min | 0 | 75 slpm | 0 | 1 psig | 0 | 0.5 | 11.3 + −1.2 μm | |

Table 1 list exemplary characteristics for a nozzle designed according to the present embodiment. It should be noted that the values in Table 1 are only examples and are not meant to limit the scope of the invention. The Table 1 values may be modified depending on the size of the nozzle used, the fluid being atomized, and a variety of other factors.

Experimental Results

The performance of the present invention was measured using hexadecane (as laboratory simulant for liquid diesel) and air (as a simulant for steam) to determine the droplet size distribution, spatial distribution and velocity distribution across the cross-section of a test chamber fabricated to contain the spray. Since air is used for mixing and as a steam simulant, in order to eliminate confusion the mixing gas will be called the dispersion air and the air simulating steam will be referred to as the atomizing air. The measurements were made with the help of a Phase Doppler Particle Analyzer (PDPA) that uses an argon ion laser for illuminating droplets. The other major components of the test apparatus included the gas and liquid supply, mixing nozzle, a test chamber and liquid recovery and recirculation assembly. The hexadecane fuel simulant was supplied via a peristaltic pump to nozzle assembly. The atomizing air and dispersion air were supplied from the same lab air source, but through separate valved and instrumented lines that independently controlled the flow rates and pressures.

The liquid and gas flows were combined in the multi-fluid nozzle as described above, and the nozzle was mounted on the top of a lexan chamber to contain the hexadecane spray. The spray in the lexan chamber was characterized by measuring the droplet diameter, droplet velocity and number concentration as a function of spatial location with PDPA. The probe volume of the PDPA was set to characterize the spray at a distance of 2" below the outlet of the nozzle cap. This was determined by the diameter of the spray as a function of the distance from the nozzle. It was deemed desirable to measure the spray at the location where the diameter of the spray was approximately equal to the diameter of the reformer monolith. Since the diameter of the reformer used was 1.5", measurement position increments of 0.25" was considered sufficient to characterize the sprays. Spray characteristics were determined for start-up, low flow and high flow conditions.

During start-up steam is not available but liquid water has to be introduced gradually until it turns to steam in one of the Example 1-Start-Up Conditions At start-up conditions the hexadecane spray was only visible using special lighting techniques. With white backlighting the spray was observed as a low density, fine shower spray. Laser light visually indicated a relatively uniform scattering intensity across the entire 4" width of the lexan chamber. Here the atomizing (steam simulant) was not used because steam is not available during start-up condition and the dispersion air was supplied at a pressure of 1 psig.

Figure 6A:
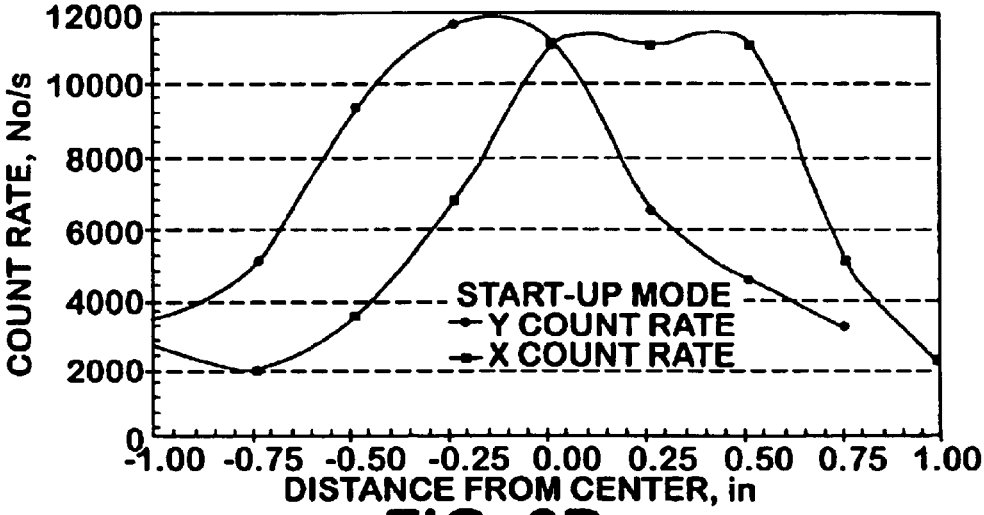
FIG. 6A—is a graph illustrating the spray characteristics during high-flow conditions, specifically count rate (No/s) vs. distance from center of the spray (in)
Figure 6B:
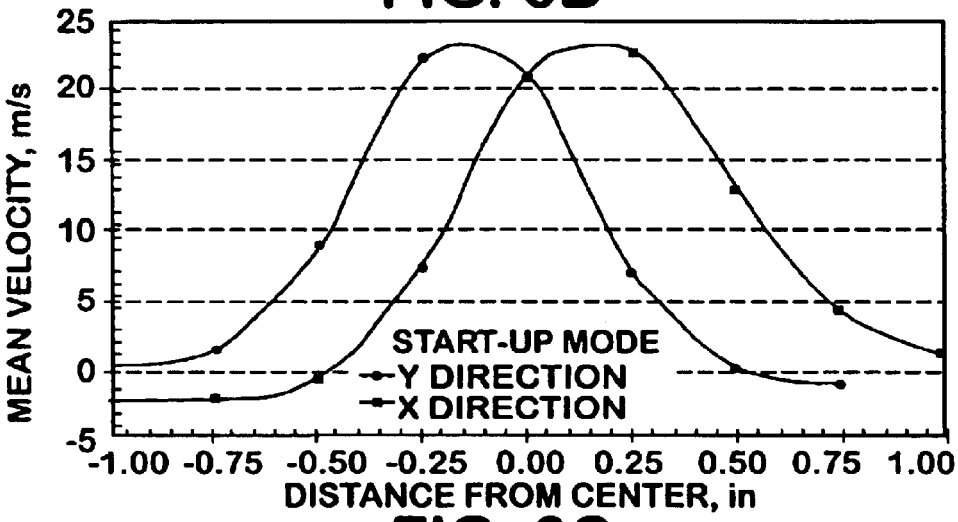
FIG. 6B—is a graph illustrating the spray characteristics during high-flow conditions, specially mean velocity (m/s) vs. distance from center for the spray (in)
Figure 6C:
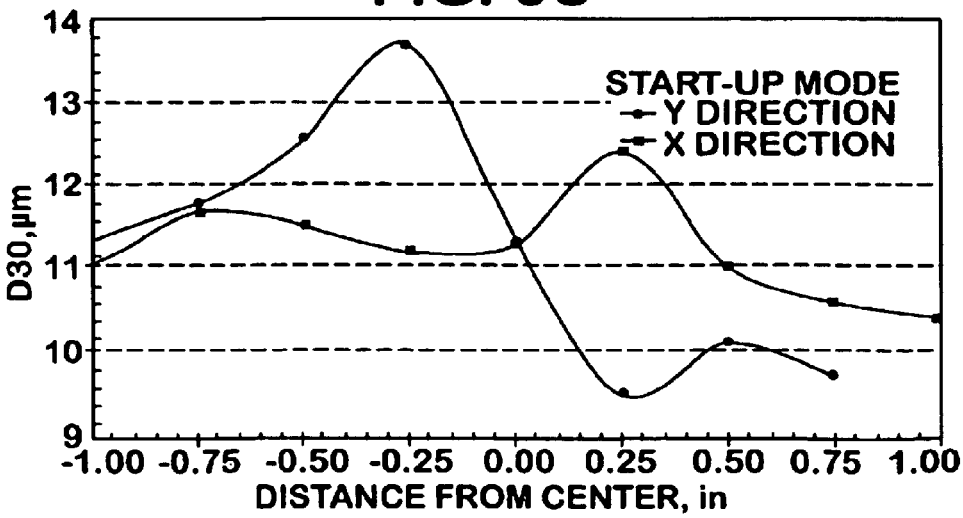
FIG. 6C—is a graph illustrating the spray characteristics during high-flow conditions, specifically D30 ($\mu$m) vs. distance from center of the spray (in).

The PDPA data is summarized in FIGS. 6A-C. At 2" from the nozzle, the average droplet count rates were 7010 particles/s, 8410 particles/s and 9410 particles's over the central 1.5", 1" and 0.5" of the spray, respectively. The corresponding standard deviations were 49%, 37% and 27%. The mass median diameters (MMD) of the droplets, as measured by the PDPA, averaged over the same three regions are 18.9±3.4 μm, 19.4±3.5 μm, and 19.2±2.6 μm. When corrected for edge effects and fit to a log normal distribution, the MMD becomes 11.3±1.2 μm, 11.5±1.3 μm, and 11.6±1.6 μm, respectively. The maximum droplet velocity measured was 22.4 m/s and occurred slightly off axis. As expected for an expanding spray jets, FIGS. 6A–C show that the central portion of the spray contains the majority of the droplets, the larger droplets, and the faster droplets. The smaller droplets were slower, fewer in number and were found at the periphery of the spray.

The velocity field in FIGS. 6A–C clearly show the existence of circulating eddies near the walls of the chamber. The eddies are asymmetric with respect to the x and y axes partly due to the manner in which purge gas was introduced into the chamber to prevent the fine spray from collecting on and fogging up the walls. The data also suggest that the finer droplets detected at the spray edges are entrained in these eddies. The extent of the recirculation will be smaller in the ATR for which the nozzle is designed. One reason is that the reactor is smaller in size, 1.5" in diameter v. 4" for the lexan chamber. Also, the axial pressure drop across the catalytic bed will cause the flow to straighten and become more uniform at the top of the reactor.

Example 2-Low Flow

Figure 5A:
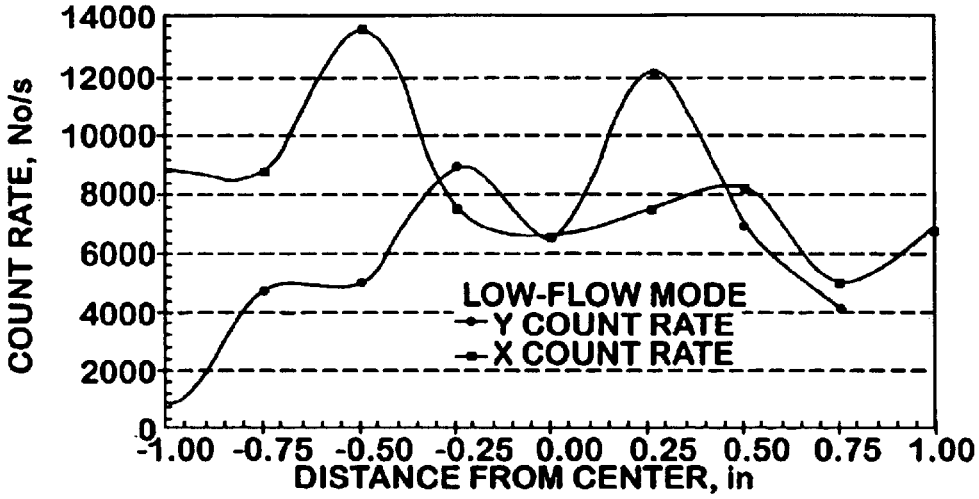
FIG. 5A—is a graph illustrating the spray characteristics during low-flow conditions, specifically count rate (No/s) vs. distance from center of the spray (in)
Figure 5B:
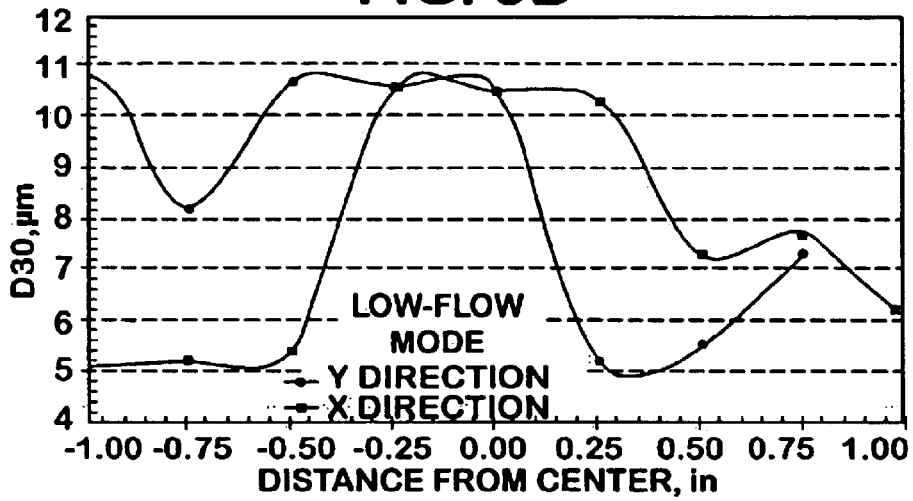
FIG. 5B—is a graph illustrating the spray characteristics during low-flow conditions, specifically D30 ($\mu$m) vs. distance from center of the spray (in)
Figure 5C:
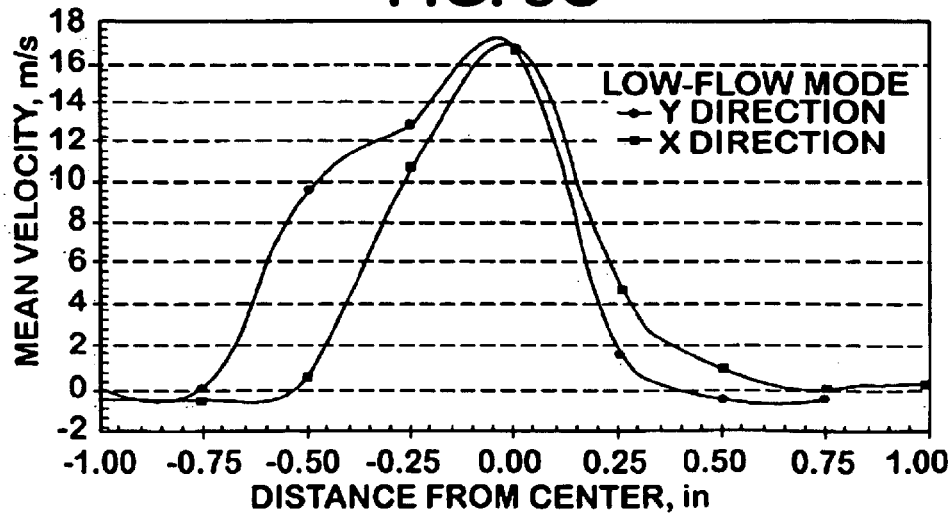
FIG. 5C—is a graph illustrating the spray characteristics during low-flow conditions, specifically mean velocity (m/s) vs. distance from center of the spray (in)

In the low flow mode (3 cc/min fuel flow rate, 7.1 slpm atomization gas flow rate and 25 slpm dispersion gas flow rate), the nozzle produced a fog like spray that was immediately visible in the test chamber. The appearance of the fog is indicative of the presence of fine droplets generated with the high pressure (10 psig) atomizing air. Just upstream of the nozzle, the supply pressure of the atomization air was 10 psig and the dispersion air was about 1 psig. See FIGS. 5A–C. For the PDPA data. The average droplet count rate over the central 1.5" of the spray at 2" from the nozzle was measured to be 7625 particles/s, which is slightly higher than at start-up flow. A standard deviation of 37% implies a more uniform spray than under start-up conditions. These measurements are consistent with the visual observations of the low flow spray. The average droplet count rates over the central 1" and 0.5" of the spray were measured to be 8500 particles/s and 8550 particles/s, respectively, with standard deviations of 32% and 25%.

The average MMD of the droplets in the central 1.5" of the spray was 11.8±3.3 μm while the corrected and fitted MMD was 8.0±2.3 μm. The MMD when averaged over the central 1" of the spray increases to 12.8±2.3 μm (8.4±2.5 μm fitted). The MMD averaged over the central 0.5" of the spray is 14.5±3.0 μm (9.5±2.4 μm fitted). The measurement of the smaller diameter droplets for the low flow conditions compared to at start-up is consistent with visual observations and atomization theory. The maximum droplet velocity was measured as 16.7 m/s and occurs on axis. This velocity is lower than the maximum measured start-up flow velocity because the dispersion air through the nozzle in the low flow test is only one third of that at the start-up.

Example 3-High Flow

Figure 4A:
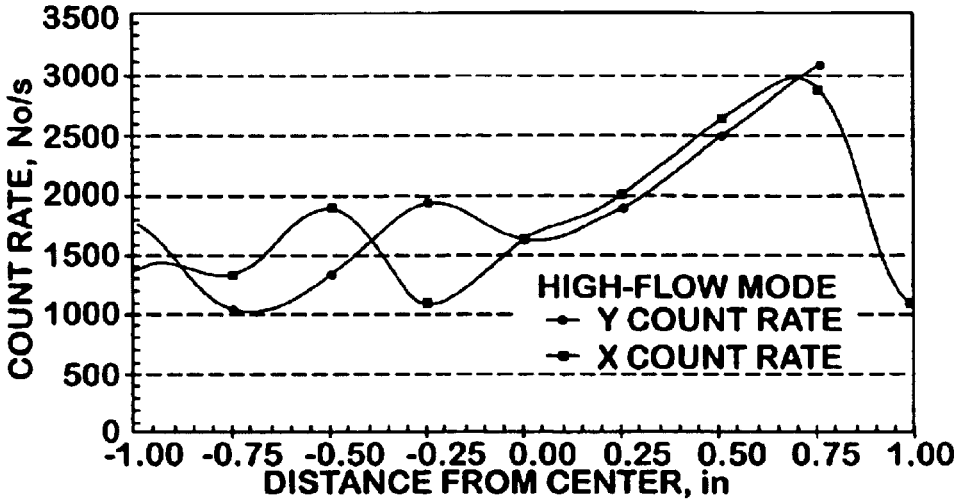
FIG. 4A—is a graph illustrating the spray characteristics during start-up conditions, specifically count rate (No/s) vs. distance from center of the spray (in)
Figure 4B:
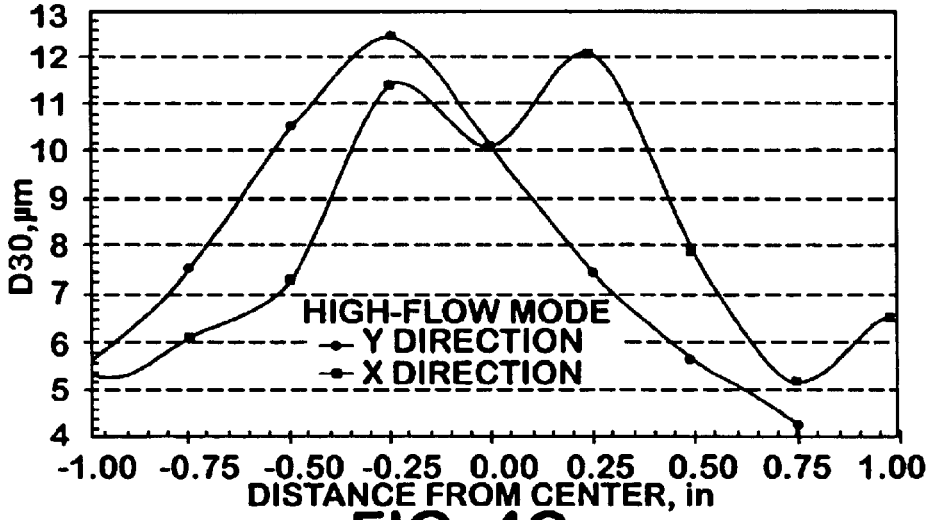
FIG. 4B—is a graph illustrating the spray characteristics during start-up conditions, specifically D30, ($\mu$m) vs. distance from center of the spray (in)
Figure 4C:
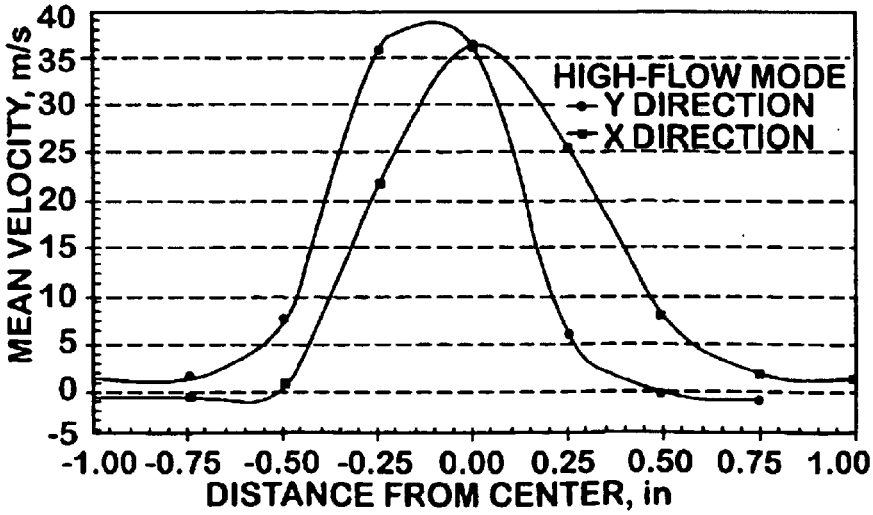
FIG. 4C—is a graph illustrating the spray characteristics during start-up conditions, specifically count rate (No/s) vs. distance from center of the spray (in)

Visually, the nozzle produces an even denser fog under high flow rate conditions. The fog is immediately visible without added illumination. The PDPA data for the high flow rate spray is summarized in FIGS. 4A-C. The average count rate over the central 1.5" of the spray is only 1951 particles/s, which is much lower than either start-up or low flow count rates. This is attributed to the density of the fog. It is well known that the signal scattered out of the probe volume can be subsequently scattered out of the receiving optics by particles outside the probe volume. It follows that the greater the spray density, the higher the probability of signal loss. Another mechanism that causes reduced count rate at high number densities is the increased probability of two or more particles being located within the probe volume simultaneously. Anytime two ore more particles are in the probe volume at the same time, the received signal is a composite of all the individual signals from each particle in the volume. The signals cannot be deconvoluted so the PDPA software rejects the signal completely, reducing the count rate. However, the standard deviation of 34% is still believed to be indicative of the uniformity of the spray.

The MMD over the central 1.5" of the spray was measured at 11.4±2.6 μm and the corrected and fitted value is 8.3±2.7 μm. The average MMD over the central 1.0" of the spray is measured as 12.5±2.3 μm (9.4±2.4 μm fitted) and is 13.6±1.8 μm (10.7±2.0 μm fitted) in the central 0.5" of the spray. These measurements are consistent with the measurements in the low flow case and with visual observations. However, if the first hypothesis that explains the reduced count rate is correct, it would imply that the particle size measurements might also be affected. Since smaller particles produce a weaker signal, signal loss due to scattering from particles outside of the probe volume, it also follows that the signals from the smaller particles are more likely to be lost to the receiving optics. If the second hypothesis is dominant, then the count rate would be reduced, but the size of the data would still be valid. Considering the uncertainty of these factors, it is reasonable to treat the size data as an indication of the largest size distribution that can be produced by the nozzle under the high flow conditions, but that the actual size distribution might be smaller.

Having described the basic concept of the invention, it will be apparent to those skilled in the art that the foregoing detailed disclosure is intended to be presented by way of example only, and is not limiting. Various alterations, improvements, and modifications are intended to be suggested and are within the scope and spirit of the present invention. Additionally, the recited order of the elements or sequences, or the use of numbers, letters or other designations therefore, is not intended to limit the claimed processes to any order except as may be specified in the claims. Accordingly, the invention is limited only by the following claims and equivalents thereto.

All publications and patent documents cited in this application are incorporated by reference in their entirety for all purposes to the same extent as if each individual publication or patent document were so individually denoted.

We claim the following:

1. A multi-fluid atomizing nozzle comprising:

a nozzle body of defined shape having a first and second end, the nozzle body having a nozzle body chamber located proximal to the second end of the nozzle body, the nozzle body having an outer surface, the nozzle body having a nosepiece of defined size and shape incorporated into the nozzle body, the nosepiece having a first and second end, the nosepiece being located at the second end of the nozzle body, the nosepiece protruding out from the nozzle body, the nosepiece having a nosepiece chamber with a first and second end, the nozzle body chamber flowing into the nosepiece chamber, the second end of the nosepiece having an aperture allowing fluid communication between the inside of the nosepiece chamber and the exterior of the nozzle body;

a nozzle cap having a first and second end, the nozzle cap having a shape complimentary to the defined shape of second end of the nozzle body, the nozzle cap further having an inner and outer surface, the first end of the nozzle cap being open, the second end of the nozzle cap being closed with the exception of a nozzle cap aperture of defined diameter;

a means for mating the nozzle cap with the second end of the nozzle body;

a mixing chamber formed by the mating of the second end of the nozzle body and the first end of the nozzle cap, when mated together there being a specified distance between the second end of the nozzle body and the inner surface of the second end of the nozzle cap;

a means for supplying and directing a stream of dispersion gas to the mixing chamber;

a means for supplying and directing a stream of feed stock to the nozzle body chamber;

a means for supplying and directing a stream of atomizing fluid to the nozzle body chamber.

2. A multi-fluid atomizing nozzle as described in claim 1, wherein the feed stock means and atomizing fluid means are oriented in a way to achieve a mixing of the two streams during normal operation.

3. A multi-fluid atomizing nozzle as described in claim 1, wherein the feed stock and atomizing fluid streams are angled towards the center of the first end of the nosepiece chamber.

4. A multi-fluid atomizing nozzle as described in claim 1 wherein, the feed stock and atomizing streams are angled towards the center of the nosepiece chamber at an angle between 0–60' off center.

5. A multi-fluid atomizing nozzle as described in claim 1 wherein, the feed stock and atomizing streams are angled towards the center of the nosepiece chamber at an angle of approximately 30' off center.

6. A multi-fluid atomizing nozzle as described in a claim 1 wherein, the nosepiece aperture and nozzle cap aperture are axially aligned.

7. A multi-fluid atomizing nozzle as described in claim 1, wherein the means for supplying a stream of feed stock is a feed stock tube having a first and second end, the feed stock tube having a defined diameter, the feed stock tube being attached to and partially housed within the nozzle body, the first end of the feed stock extending out from the first end of the nozzle body, the second end of the feed stock tube terminating in the nozzle body's chamber, wherein the first end of the feed stock tube being connected to a feed stock supply.

8. A multi-fluid atomizing nozzle as described in claim 1, wherein the means for supplying a stream of atomizing fluid is an atomizing fluid tube having a first and second end, the first end of the atomizing fluid tube having a defined diameter, the second end of the atomizing fluid tube having a narrower diameter than the first end, the atomizing fluid tube being attached to and partially housed within the nozzle body, the first end of the atomizing fluid tube extending out from first end of the nozzle body, the second end of the atomizing fluid tube terminating in the nozzle body's chamber, wherein the first end of the atomizing fluid tube is connected to a supply of atomizing fluid.

9. A multi-fluid atomizing nozzle as described in claim 1, wherein the dispersion gas means is a dispersion gas tube having a first and second end, the dispersion gas tube having a defined diameter, the dispersion gas tube running lengthwise through the nozzle body, the first end of the feed stock extending out from the nozzle body, the dispersion gas tube being attached to and housed within the nozzle body, wherein the dispersion gas tube is connected to a supply of dispersion gas.

10. A multi-fluid atomizing nozzle as described in claim 1, wherein the feed stock is a hydrocarbon.

11. A multi-fluid atomizing nozzle as described in claim 1, wherein the feed stock is a viscous fluid.

12. A multi-fluid atomizing nozzle as described in claim 1, wherein the dispersion gas is an oxidant.

13. A multi-fluid atomizing nozzle as described in claim 1, wherein the dispersion gas is air.

14. A multi-fluid atomizing nozzle as described in claim 1, wherein the atomizing fluid is water.

15. A multi-fluid atomizing nozzle as described in claim 1, wherein the defined shape of the nozzle body is cylindrical.

16. A multi-fluid atomizing nozzle as described in claim 1 wherein, the defined shape of the nosepiece is cylindrical.

17. A multi-fluid atomizing nozzle as described in claim 1 wherein, the distance between the second end of the nozzle body and second end of the nozzle cap is between 0.175"–0.375".

18. A multi-fluid atomizing nozzle as described in claim 1 wherein, the distance between the second end of the nozzle body and second end of the nozzle cap is preferably between 0.225"–0.275".

19. A multi-fluid atomizing nozzle as described in claim 1 wherein, the length of the nosepiece is approximately 0.125".

20. A multi-fluid atomizing nozzle as described in claim 1, wherein the length of the nosepiece is between 0.075" and 0.175".

21. A multi-fluid atomizing nozzle as described in claim 1 wherein the diameter of the nosepiece aperture is between 0.010–0.250".

22. A multi-fluid atomizing nozzle as described in claim 1 wherein the diameter of the cap aperture is between 0.05–1".

23. A multi-fluid atomizing nozzle as described in claim 9 wherein the diameter of the dispersion gas tube is between 0.20"–0.75".

24. A multi-fluid atomizing nozzle as described in claim 8 wherein the diameter of the first end of the atomizing tube is between 0.10"–0.50".

25. A multi-fluid atomizing nozzle as described in claim 8 wherein the diameter of the second end of the atomizing tube is between 0.010"–10".

26. A multi-fluid atomizing nozzle as described in claim 7 wherein the diameter of the first end of the feed stock tube is between 0.08"–0.160".

27. A multi-fluid atomizing nozzle as described in claim 7 wherein the diameter of the second end of the feed stock tube is between 0.005"–0.030".

28. A method of atomizing fluids comprising:

teeming a stream of feed stock liquid into a first chamber the chamber having at least one high pressure atomization jet, when available a stream of atomizing fluid emanating from the atomizing jet(s);

orienting the feed stock and atomization streams in way to achieve a mixing of the two streams, during normal operating conditions the mixing creating a stream of atomizing fluid-feed stock fluid mixed spray;

directing the stream of atomizing-feed stock mixed spray into a second chamber;

radially inserting a dispersion gas into the second chamber, forming a well mixed atomizing fluid-feed stock fluid-dispersion gas mixture;

directing the atomizing fluid-feed stock-dispersion gas mixture to a desired location.

29. A method of atomizing fluids as described in claim 28 wherein, the feed stock forms a film of feed stock between the first and second chambers when the high pressure atomization fluid is unavailable;

the dispersion gas radially contacting the feed stock film atomizing the feed stock into atomized feed stock-dispersion gas spray;

directing the atomized feedstock-dispersion air spray to a desired location.

30. A method of atomizing fluids in claim 28 wherein, the feed stock stream is atomized by the atomization stream during normal operational conditions.

31. A method of atomizing fluids in claim 28 wherein, the atomizing fluid is water, and where in the water is pumped at low pressure into the first chamber.

32. The method described in claim 28 wherein, the pressure of the atomization fluid is between 5–200 psi, during normal operating conditions.

33. The method described in claim 28 wherein, the pressure of the atomization fluid is preferably between 10–60 psi, during normal operating conditions.

34. The method described in claim 28 wherein, the pressure of the dispersion gas is approximately 1 psi.

35. The method described in claim 28 wherein, the pressure of the feed stock is between 0.5–100 psi.

36. The method described in claim 28 wherein, the flow rate of the dispersion gas is between 15–300 slpm.

37. The method described in claim 28 wherein, the flow rate of the feed stock is between 2–50 cc/min.

38. The method described in claim 28 wherein, the flow rate of the liquid equivalent of the atomizing fluid is between 0–100 cc/min.

39. The method described in claim 28 wherein, the feed stock is a heavy hydrocarbon.

40. The method described in claim 28 wherein, the feed stock is viscous fluid.

41. The method described in claim 28 wherein, the feed stock is diesel.

42. The method described in claim 28 wherein, the atomizing fluid is water, particularly in the form of steam.

43. The method described in claim 28 wherein, the dispersion gas is an oxidant.

44. The method described in claim 28 wherein, the dispersion gas is air.

45. The method described in claim 28 wherein, the dispersion gas is $O_2$.

46. A multi-fluid atomizing nozzle comprising:

a nozzle body of defined shape having a first and second end, the second end of the nozzle body having a chamber located proximal to the second end of the nozzle body, the nozzle body having an outer surface, the nozzle body having a nose piece of defined size and shape located at the second end of the nozzle body, the nosepiece protruding out from the nozzle body, the nosepiece also having a chamber, the nozzle body's central chamber flowing into the nosepiece chamber, the nosepiece having an aperture allowing fluid communication between the inside of the nosepiece chamber and the exterior of the nozzle body, the nozzle body further having a atomizing fluid channel, feed stock channel and a dispersion gas channel, the dispersion gas channel having a defined diameter, the dispersion channel having a first and second end, the dispersion gas channel running the length of the nozzle body;

the feed stock channel having a first and second end, the feed stock channel beginning at the first end of the nozzle body and terminating in the nozzle body's chamber, the feed stock channel having a defined diameter, the second end of the feed stock channel having a specified orientation;

the atomizing fluid channel having a first and second end, the feed stock channel beginning at the first end of the nozzle body and terminating in the nozzle body's chamber, the first end of the atomizing fluid channel having a defined diameter, the second end of the atomizing fluid channel having a narrower diameter than the first end, the second end of the atomizing fluid channel having a specified orientation, wherein the atomizing fluid and feed stock channels are oriented in a way to achieve mixing of their two streams;

a nozzle cap having a first and second end, the nozzle cap having a cup-like shape complimentary to the defined shape of second end of the nozzle body, the nozzle cap further having an inner and outer surface, wherein the inner surface of the first end of the nozzle cap engages and attaches to the outer surface of the second end of the nozzle body, the second end of the nozzle cap being closed with the exception of an aperture of defined diameter;

a mixing chamber formed by the mating of second end of the nozzle body and the first end of the nozzle cap, there being a specified distance between the nosepiece and the inner surface of the second end of the nozzle cap, there also being a specified distance between the second end of the nozzle body and the inner surface of the second end of the nozzle cap.

* * * * *